US011730321B2

(12) United States Patent
Key

(10) Patent No.: US 11,730,321 B2
(45) Date of Patent: Aug. 22, 2023

(54) BATHTUB CLEANER ASSEMBLY

(71) Applicant: Javern Robert Key, Hermantown, MN (US)

(72) Inventor: Javern Robert Key, Hermantown, MN (US)

( * ) Notice: Subject to any disclaimer, the term of this patent is extended or adjusted under 35 U.S.C. 154(b) by 325 days.

(21) Appl. No.: 17/242,660

(22) Filed: Apr. 28, 2021

(65) Prior Publication Data

US 2022/0346604 A1 Nov. 3, 2022

(51) Int. Cl.

| | |
|---|---|
| ***A46B 13/00*** | (2006.01) |
| ***A47K 3/00*** | (2006.01) |
| ***A46B 13/04*** | (2006.01) |
| *A47L 11/40* | (2006.01) |

(52) U.S. Cl.

CPC ..... *A47K 3/001* (2013.01); *A46B 13/001* (2013.01); *A46B 13/04* (2013.01); *A47K 3/00* (2013.01); *A46B 2200/3073* (2013.01); *A47L 11/40* (2013.01)

(58) Field of Classification Search

CPC ..... A46B 13/01; A47K 3/00; A47L 11/40

See application file for complete search history.

(56) References Cited

U.S. PATENT DOCUMENTS

| | | | | |
|---|---|---|---|---|
| 3,526,916 | A | 9/1970 | Thomas | |
| 3,731,334 | A * | 5/1973 | Carbonell | A47L 11/408 15/29 |
| 4,399,578 | A | 8/1983 | Bordeaux | |
| 5,093,955 | A | 3/1992 | Blehert | |
| 6,076,228 | A * | 6/2000 | Aiken | A47L 11/34 15/373 |
| 6,742,199 | B2 | 6/2004 | Conway | |
| D876,036 | S | 2/2020 | Irfan | |
| 2009/0229069 | A1* | 9/2009 | Lenkiewicz | A47L 11/4088 15/320 |
| 2015/0313435 | A1* | 11/2015 | Citsay | A47L 11/405 134/6 |
| 2017/0055692 | A1 | 3/2017 | Wobill | |
| 2021/0251444 | A1* | 8/2021 | Pruiett | A47L 9/0411 |

FOREIGN PATENT DOCUMENTS

| | | |
|---|---|---|
| WO | WO2019154660 | 8/2019 |

* cited by examiner

*Primary Examiner* — Michael D Jennings

(57) ABSTRACT

A bathtub cleaner assembly includes a cleaner that has a handle portion extending upwardly from a reservoir portion that contains a fluid cleaning solution. A first scrubbing unit is coupled to the reservoir portion of the cleaner to engage a basal wall of the bathtub when the cleaner is positioned in the bathtub. The first scrubbing unit rotates when the first scrubbing unit is turned on to scrub the basal wall of the bathtub. A pair of second scrubbing units is each movably integrated into the reservoir portion of the cleaner to scrub a respective lateral wall of the bathtub when the cleaner is positioned in the bathtub. A spray unit is integrated into the cleaner to spray the fluid cleaning solution onto the first scrubbing unit and the second scrubbing units.

13 Claims, 5 Drawing Sheets

BATHTUB CLEANER ASSEMBLY

CROSS-REFERENCE TO RELATED APPLICATIONS

Not Applicable

STATEMENT REGARDING FEDERALLY SPONSORED RESEARCH OR DEVELOPMENT

Not Applicable

THE NAMES OF THE PARTIES TO A JOINT RESEARCH AGREEMENT

Not Applicable

INCORPORATION-BY-REFERENCE OF MATERIAL SUBMITTED ON A COMPACT DISC OR AS A TEXT FILE VIA THE OFFICE ELECTRONIC FILING SYSTEM

Not Applicable

STATEMENT REGARDING PRIOR DISCLOSURES BY THE INVENTOR OR JOINT INVENTOR

Not Applicable

BACKGROUND OF THE INVENTION

(1) Field of the Invention

The disclosure relates to cleaner devices and more particularly pertains to a new cleaner device for automatically cleaning a bathtub. The device includes a plurality of scrubbers that rotate for scrubbing the bathtub and the device includes a plurality of rollers for moving the device back and forth in the bathtub. Additionally, the device includes a spray unit for spraying a liquid cleaning solution onto the bathtub to enhance scrubbing the bathtub.

(2) Description of Related Art Including Information Disclosed Under 37 CFR 1.97 and 1.98

The prior art relates to cleaner devices including a variety of bathtub scrubbers that have a powered scrubber for scrubbing a bathtub. The prior art discloses a variety of floor cleaners that are self propelled and which include scrubbers for scrubbing a floor. In no instance does the prior art disclose a self propelled cleaner that includes a scrubber for scrubbing a floor and a pair of scrubbers that alternatively travel up and down for scrubbing walls.

BRIEF SUMMARY OF THE INVENTION

An embodiment of the disclosure meets the needs presented above by generally comprising a cleaner that has a handle portion extending upwardly from a reservoir portion that contains a fluid cleaning solution. A first scrubbing unit is coupled to the reservoir portion of the cleaner to engage a basal wall of the bathtub when the cleaner is positioned in the bathtub. The first scrubbing unit rotates when the first scrubbing unit is turned on to scrub the basal wall of the bathtub. A pair of second scrubbing units is each movably integrated into the reservoir portion of the cleaner to scrub a respective lateral wall of the bathtub when the cleaner is positioned in the bathtub. A spray unit is integrated into the cleaner to spray the fluid cleaning solution onto the first scrubbing unit and the second scrubbing units.

There has thus been outlined, rather broadly, the more important features of the disclosure in order that the detailed description thereof that follows may be better understood, and in order that the present contribution to the art may be better appreciated. There are additional features of the disclosure that will be described hereinafter and which will form the subject matter of the claims appended hereto.

The objects of the disclosure, along with the various features of novelty which characterize the disclosure, are pointed out with particularity in the claims annexed to and forming a part of this disclosure.

BRIEF DESCRIPTION OF SEVERAL VIEWS OF THE DRAWING(S)

The disclosure will be better understood and objects other than those set forth above will become apparent when consideration is given to the following detailed description thereof. Such description makes reference to the annexed drawings wherein.

DETAILED DESCRIPTION OF THE INVENTION

Figure 1:
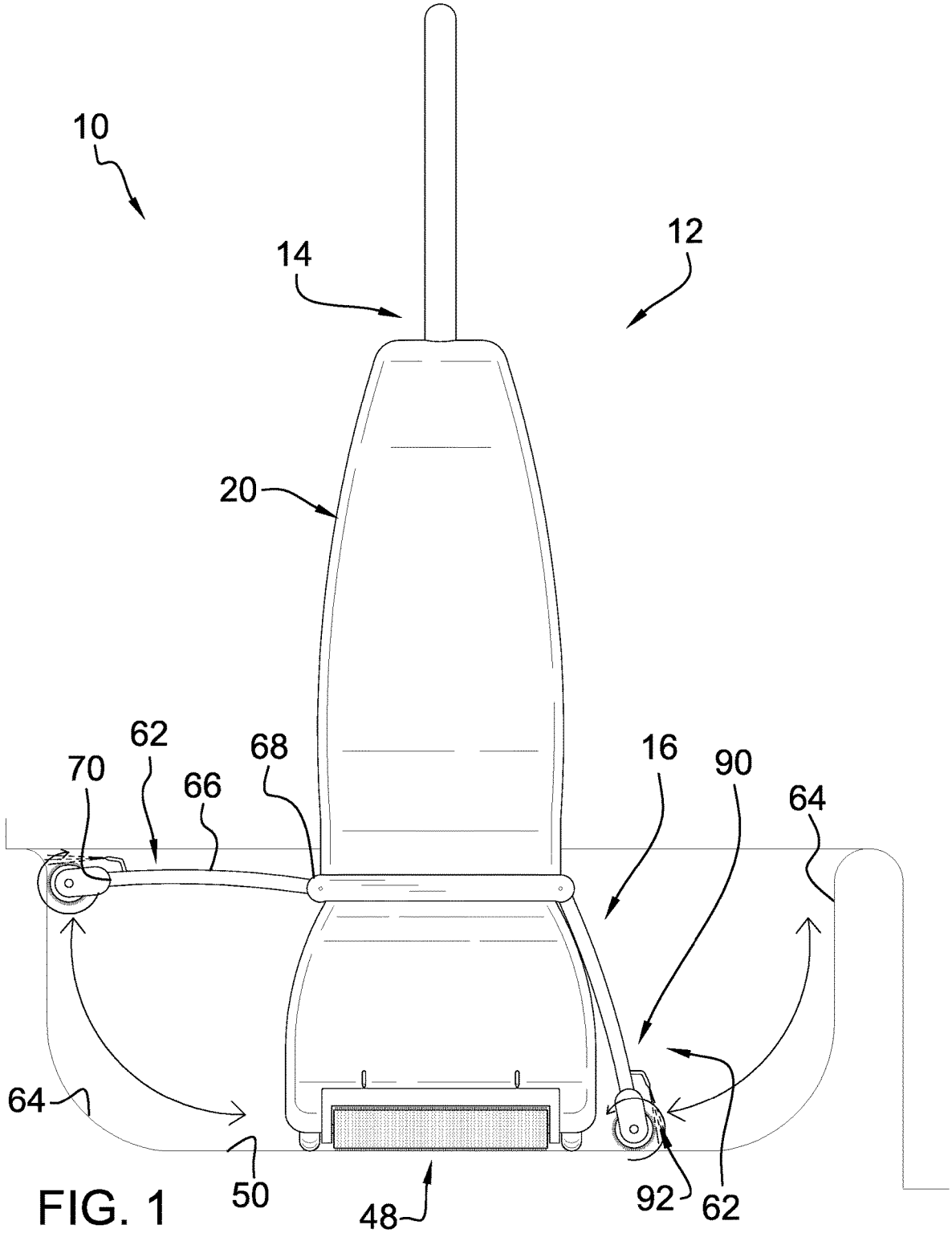
FIG. 1 is a front in-use view of a bathtub cleaner assembly according to an embodiment of the disclosure.
Figure 2:
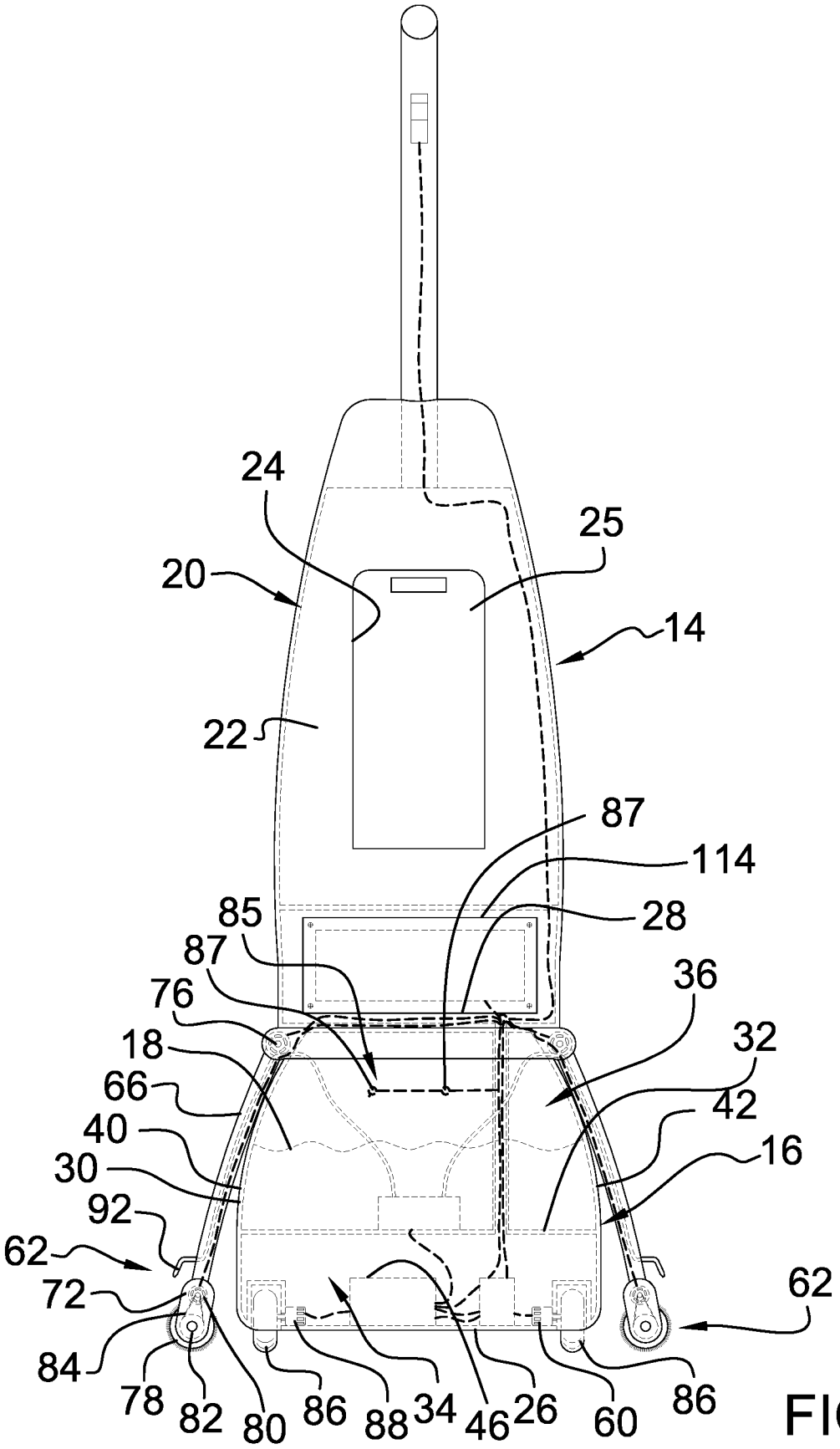
FIG. 2 is a front phantom view of an embodiment of the disclosure.
Figure 3:
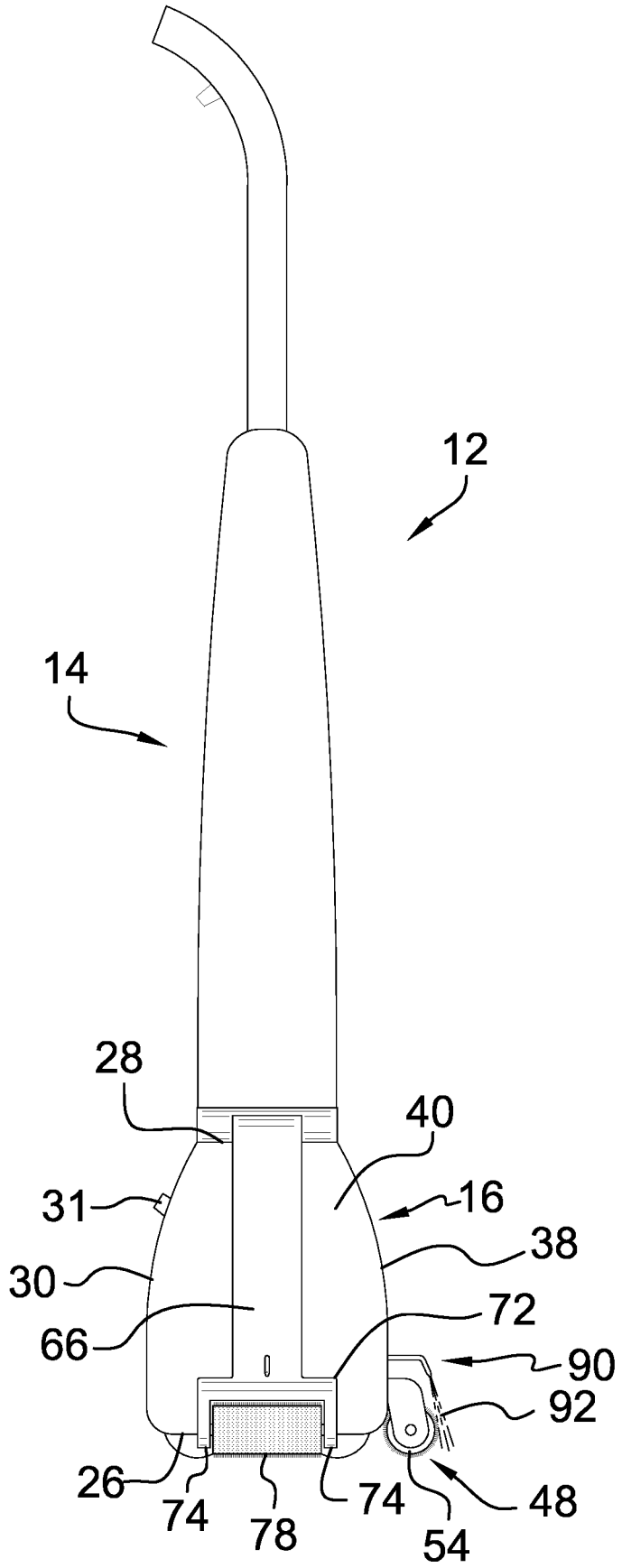
FIG. 3 is a right side view of an embodiment of the disclosure.
Figure 4:
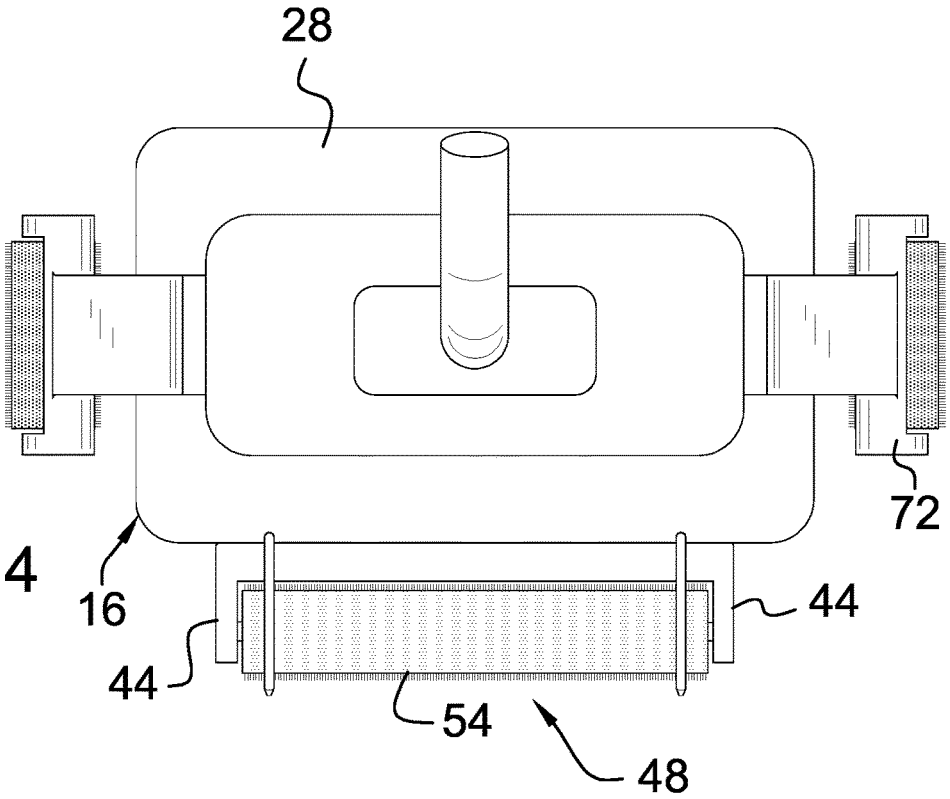
FIG. 4 is a top view of an embodiment of the disclosure.
Figure 5:
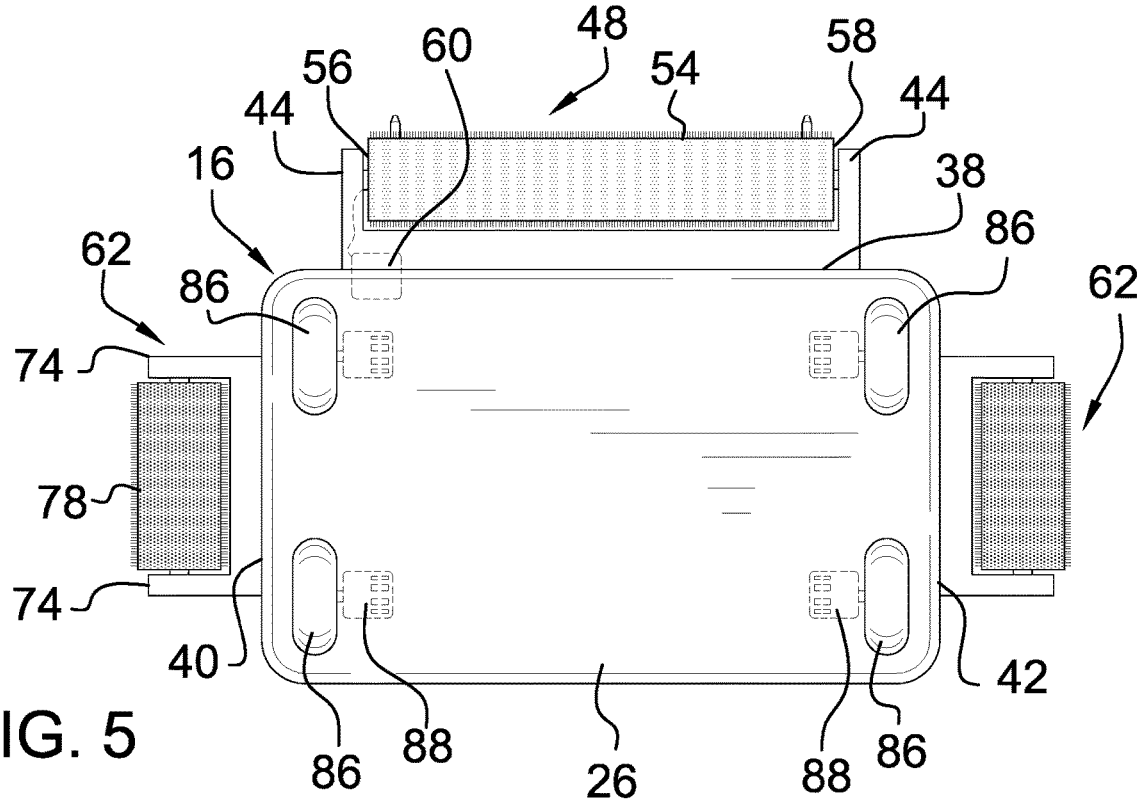
FIG. 5 is a bottom view of an embodiment of the disclosure.
Figure 6:
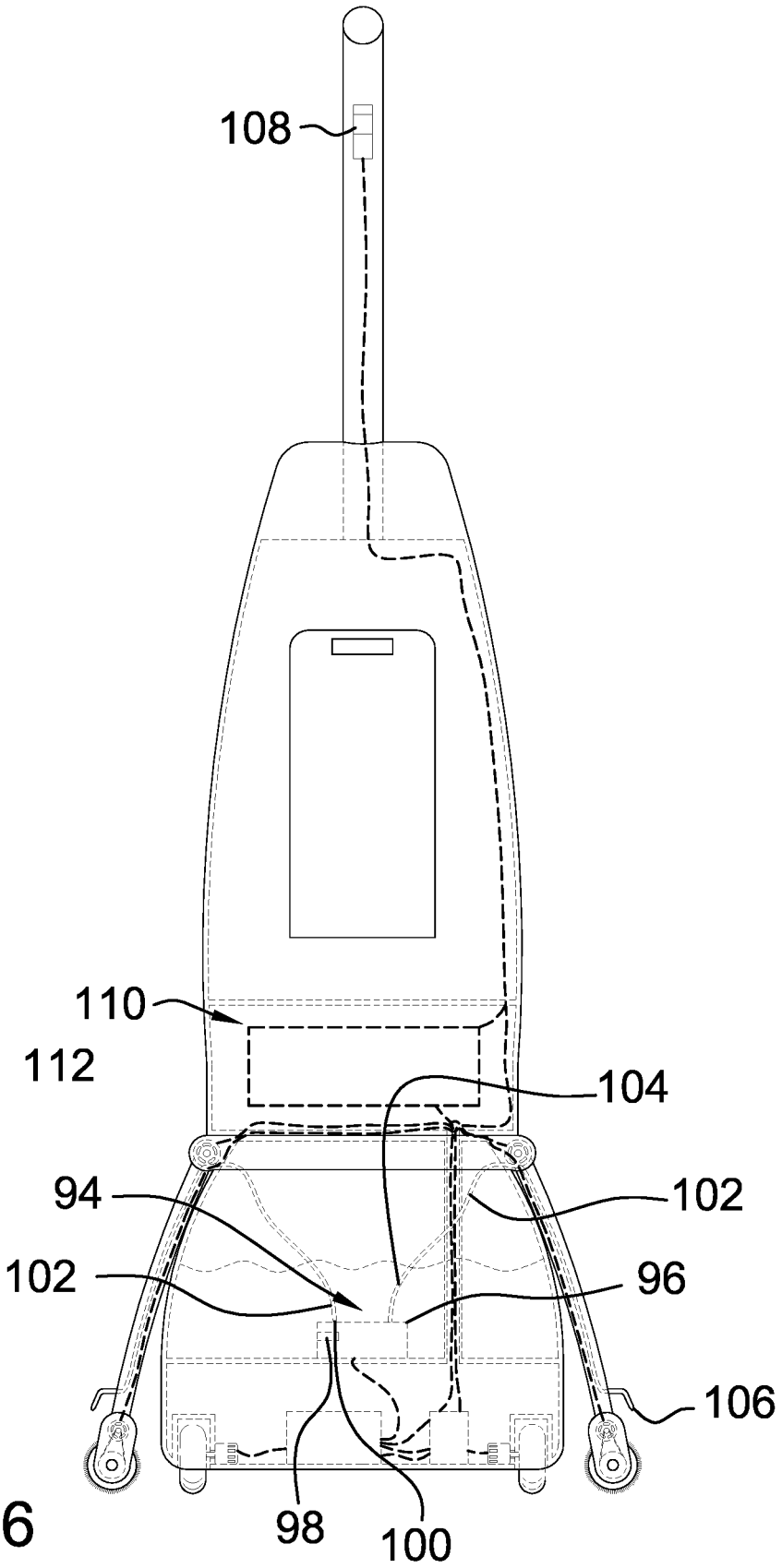
FIG. 6 is a back phantom view of an embodiment of the disclosure.

With reference now to the drawings, and in particular to FIGS. 1 through 6 thereof, a new cleaner device embodying the principles and concepts of an embodiment of the disclosure and generally designated by the reference numeral 10 will be described.

As best illustrated in FIGS. 1 through 6, the bathtub cleaner assembly 10 generally comprises a cleaner 12 that has a handle portion 14 extending upwardly from a reservoir portion 16. The reservoir portion 16 contains a fluid cleaning solution 18 and the handle portion 14 has a storage section 20 that is hollow for storing objects. The objects might include cleaning supplies that would typically be employed for cleaning a bathtub 21 in a bathroom. An outside wall 22 of the storage section 20 has an access opening 24 extending into an interior of the storage section 20 and a door 25 is removably positionable over the access opening 24.

The reservoir portion 16 has a bottom wall 26, a top wall 28 and an outer wall 30 extending therebetween, and a fill spout 31 might be integrated into the outer wall 30 for filling the reservoir portion 16 with the fluid cleaning solution 18. The reservoir portion 16 has a dividing wall 32 that is positioned between the bottom wall 26 and the top wall 28 to define a lower section 34 of the reservoir portion 16 that is fluidly discrete from an upper section 36 of the reservoir portion 16, and the upper section 36 contains the fluid cleaning solution 18. The fluid cleaning solution 18 may be a cleaning solution that is approved for cleaning plumbing fixtures, such as a bathtub 21, in a bathroom. The outer wall 30 has a front side 38, a first lateral side 40 and a second lateral side 42, and the front side 38 has a pair of mounts 44 each extending forwardly therefrom. The mounts 44 are spaced apart from each other on the front side 38, and each of the mounts 44 is positioned adjacent to the bottom wall 26 of the reservoir portion 16.

A control circuit 46 is provided and the control circuit 46 is integrated into the cleaner 12. A first scrubbing unit 48 is coupled to the reservoir portion 16 of the cleaner 12 and the first scrubbing unit 48 engages a basal wall 50 of a bathtub 21 when the cleaner 12 is positioned in the bathtub 21. The first scrubbing unit 48 rotates when the first scrubbing unit 48 is turned on thereby facilitating the first scrubbing unit 48 to scrub the basal wall 50 of the bathtub 21.

The first scrubbing unit 48 comprises a first brush 54 that has a first end 56 and a second end 58. Each of the first end 56 and the second end 58 is rotatably coupled to a respective one of the mounts 44 on the front side 38 of the outer wall 30 of the reservoir portion 16. In this way the first brush 54 can frictionally engage the basal wall 50 of the bathtub 21. The first brush 54 may include a plurality of bristles or the first brush 54 may be comprised of an abrasive material. The first scrubbing unit 48 includes a first brush motor 60 that is coupled to the reservoir portion 16 of the cleaner 12, and the first brush motor 60 is in mechanical communication with the first scrubber. The first brush motor 60 rotates in a first direction when the first brush motor 60 is turned on, the first brush motor 60 rotates the first scrubber when the first brush motor 60 is turned on, and the first brush motor 60 is electrically coupled to the control circuit 46. The first brush motor 60 may comprise an electric motor or the like.

A pair of second scrubbing units 62 is each movably integrated into the reservoir portion 16 of the cleaner 12. Each of the second scrubbing units 62 is positioned on opposite sides of the cleaner 12 with respect to each other. Moreover, each of the second scrubbing units 62 moves continuously between a lowered position and a raised position when the second scrubbing units 62 are turned on. In this way each of the second scrubbing units 62 can scrub a respective lateral wall 64 of the bathtub 21 when the cleaner 12 is positioned in the bathtub 21.

Each of the second scrubbing units 62 comprises an arm 66 that has a first end 68 and a second end 70, and the first end 68 of the arm 66 is pivotally coupled to the outer wall 30 of the reservoir portion 16 of the cleaner 12. Each of the second scrubbing units 62 includes a motor housing 72 that is coupled to the second end of the arm 66. As is most clearly shown in FIG. 3, the motor housing 72 has a pair of panels 74 that are spaced apart from each other and extend away from the second end of the arm 66.

Each of the second scrubbing units 62 includes an arm motor 76 that is positioned within the arm 66, the arm motor 76 is positioned at the first end of the arm 66 and the arm motor 76 engages the outer wall 30 of the reservoir portion 16 at a pivot point between the first end and the outer wall 30. The arm motor 76 alternatively rotates in a first direction and a second direction when the arm motor 76 is turned on. The arm 66 is lifted upwardly when the arm motor 76 rotates in the first direction and the arm 66 is lowered when the arm motor 76 rotates in the second direction. The arm motor 76 is electrically coupled to the control circuit 46 and the arm motor 76 may comprise an electric motor or the like.

Each of the second scrubbing units 62 includes a second brush 78 that is rotatably coupled between the pair of panels 74 of the motor housing 72. In this way the second brush 78 can to frictionally engage the respective lateral wall 64 of the bathtub 21. The second brush 78 may include a plurality of bristles or the second brush 78 may be comprised of an abrasive material. Each of the second scrubbing units 62 includes a second brush motor 80 that is positioned in the motor housing 72, and the second brush motor 80 rotates in a first direction when the second brush motor 80 is turned on. The second brush motor 80 is electrically coupled to the control circuit 46 and the second brush motor 80 may comprise an electric motor or the like. Each of the second scrubbing units 62 includes a pulley 82 that is coupled to a respective end of the second brush 78. Each of the second scrubbing units 62 includes a belt 84 that extends between the second brush motor 80 and the pulley 82 such that the second brush motor 80 rotates the second brush 78 when the second brush motor 80 is turned on.

A plurality of rollers 86 is each integrated into the bottom wall 26 of the reservoir portion 16 of the cleaner 12 such that each of the rollers 86 rolls along the basal wall 50 of the bathtub 21 when the cleaner 12 is positioned in the bathtub 21. A plurality of roller motors 88 is each positioned in the reservoir portion 16 of the cleaner 12 and each of the roller motors 88 is coupled to a respective one of the rollers 86. Each of the roller motors 88 rotates in a first direction or a second direction when the roller motors 88 are turned on. Moreover, the cleaner 12 moves forward when the roller motors 88 rotate in the first direction and the cleaner 12 moves rearwardly when the roller motors 88 rotate in the second direction. In this way the rollers 86 move the cleaner 12 back and forth along the basal wall 50 of the bathtub 21. A guidance system 85 may be integrated into the cleaner 12 that might include a plurality of optical sensors 87 for sensing the dimensions of the bathtub 21. The guidance system 85 might be electrically coupled to the control circuit 46 to facilitate the rollers 86 to reverse direction when the cleaner 12 approaches either end of the bathtub 21 while the cleaner 12 is moving forward or rearward.

A spray unit 90 is integrated into the cleaner 12 and the spray unit 90 has a plurality of outputs 92 each being aligned with a respective one of the first scrubbing unit 48 and the second scrubbing units 62. The spray unit 90 has an input 94 that is positioned within the reservoir portion 16 of the cleaner 12. Moreover, the spray unit 90 sprays the fluid cleaning solution 18 outwardly through each of the outputs 92 for enhancing cleaning the bathtub 21. The spray unit 90 comprises a pump 96 that has an intake 98 and a plurality of exhausts 100, and the pump 96 defines the input 94 of the spray unit 90. The pump 96 is positioned within the reservoir portion 16 to facilitate the pump 96 to urge the fluid cleaning solution 18 inwardly through the intake 98 and outwardly through each of the exhausts 100 when the pump 96 is turned on. The pump 96 is electrically coupled to the control circuit 46 and the pump 96 may comprise an electric fluid pump or the like.

The spray unit 90 includes a plurality of conduits 102 that each has a primary end 104 and a secondary end 106. The primary end 104 of each of the conduits 102 is fluidly coupled to a respective one of the exhausts 100 of the pump 96 such that each of the conduits 102 receives the fluid cleaning solution 18 from the pump 96. Each of the conduits 102 is routed in the cleaner 12 such that the secondary end 106 of each of the conduits 102 is aligned with a respective one of the first brush 54 and the second brush 78 associated with each of the second scrubbing units 62. In this way each of the conduits 102 can spray the fluid cleaning solution 18 into the first brush 54 and the second brush 78. The secondary end 106 of each of the conduits 102 defines a respective one of the outputs 92 of the spray unit 90.

A power switch 108 is movably integrated into the handle portion 14 of the cleaner 12 and the power switch 108 is electrically coupled to the control circuit 46 for turning the control circuit 46 on and off. A power supply 110 is positioned in the handle portion 14 of the cleaner 12 and the power supply 110 is electrically coupled to the power switch 108. The power supply 110 comprises at least one battery 112 and the at least one battery 112 is positioned in the storage section 20 of the handle portion 14. A battery cover 114 is removably integrated into the outside wall 22 of the storage section 20 and the at least one battery 112 is positioned behind the battery cover 114.

In use, the cleaner 12 is positioned in the bathtub 21 and the power switch 108 is turned on. The cleaner 12 travels back and forth in the bathtub 21 while the first scrubbing unit 48 scrubs the basal wall 50 of the bathtub 21 and each of the second scrubbing units 62 scrubs up and down along the respective lateral wall 64 of the bathtub 21. In this way the bathtub 21 can be automatically cleaned without requiring manual labor. The power switch 108 is turned off when the cleaner 12 has traveled back and forth in the bathtub 21 a sufficient number of times to clean the bathtub 21.

With respect to the above description then, it is to be realized that the optimum dimensional relationships for the parts of an embodiment enabled by the disclosure, to include variations in size, materials, shape, form, function and manner of operation, assembly and use, are deemed readily apparent and obvious to one skilled in the art, and all equivalent relationships to those illustrated in the drawings and described in the specification are intended to be encompassed by an embodiment of the disclosure.

Therefore, the foregoing is considered as illustrative only of the principles of the disclosure. Further, since numerous modifications and changes will readily occur to those skilled in the art, it is not desired to limit the disclosure to the exact construction and operation shown and described, and accordingly, all suitable modifications and equivalents may be resorted to, falling within the scope of the disclosure. In this patent document, the word "comprising" is used in its non-limiting sense to mean that items following the word are included, but items not specifically mentioned are not excluded. A reference to an element by the indefinite article "a" does not exclude the possibility that more than one of the element is present, unless the context clearly requires that there be only one of the elements.

I claim:

1. A bathtub cleaner assembly for automatically cleaning a bathtub, said assembly comprising:

a cleaner having a handle portion extending upwardly from a reservoir portion, said reservoir portion containing a fluid cleaning solution, said handle portion having a storage section being hollow wherein said storage section is configured to store objects;

a first scrubbing unit being coupled to said reservoir portion of said cleaner wherein said first scrubbing unit is configured to engage a basal wall of the bathtub when said cleaner is positioned in the bathtub, said first scrubbing unit rotating when said first scrubbing unit is turned on wherein said first scrubbing unit is configured to scrub the basal wall of the bathtub;

a pair of second scrubbing units, each of said second scrubbing units being movably integrated into said reservoir portion of said cleaner, each of said second scrubbing units being positioned on opposite sides of said cleaner with respect to each other, each of said second scrubbing units moving continuously between a lowered position and a raised position when said second scrubbing units are turned on wherein each of said second scrubbing units is configured to scrub a respective lateral wall of the bathtub when said cleaner is positioned in the bathtub;

a plurality of rollers, each of said rollers being integrated into said reservoir portion of said cleaner wherein each of said rollers is configured to roll along the basal wall of the bathtub when said cleaner is positioned in the bathtub; and a spray unit being integrated into said cleaner, said spray unit having a plurality of outputs each being aligned with a respective one of said first scrubbing unit and said second scrubbing units, said spray unit having an input being positioned within said reservoir portion of said cleaner wherein said spray unit is configured to spray the fluid cleaning solution outwardly through each of said outputs for enhancing cleaning the bathtub.

2. The assembly according to claim 1, wherein:

an outside wall of said storage section has an access opening extending into an interior of said storage section;

said reservoir portion has a bottom wall, a top wall and an outer wall extending therebetween, said reservoir portion having a dividing wall being positioned between said bottom wall and said top wall to define a lower section of said reservoir portion being fluidly discrete from an upper section of said reservoir portion wherein said upper section is configured to contain the fluid cleaning solution; and said outer wall has a front side, a first lateral side and a second lateral side, said front side having a pair of mounts each extending forwardly therefrom, said mounts being spaced apart from each other on said front side, each of said mounts being positioned adjacent to said bottom wall of said reservoir portion.

3. The assembly according to claim 2, wherein said first scrubbing unit comprises a first brush having a first end and a second end, each of said first end and said second end being rotatably coupled to a respective one of said mounts on said front side of said outer wall of said reservoir portion wherein said first brush is configured to frictionally engage the basal wall of the bathtub.

4. The assembly according to claim 3, wherein said first scrubbing unit includes a first brush motor being coupled to said reservoir portion of said cleaner, said first brush motor being in mechanical communication with said first scrubber, said first brush motor rotating in a first direction when said first brush motor is turned on, said first brush motor rotating said first scrubber when said first brush motor is turned on, said first brush motor being electrically coupled to a control circuit.

5. The assembly according to claim 2, wherein each of said second scrubbing units comprises:

an arm having a first end and a second end, said first end being pivotally coupled to said outer wall of said reservoir portion of said cleaner; and a motor housing being coupled to said second end of said arm, said motor housing having a pair of panels being spaced apart from each other and extending away from said second end of said arm.

6. The assembly according to claim 5, wherein each of said second scrubbing units includes an arm motor being positioned within said arm, said arm motor being positioned at said first end of said arm, said arm motor engaging said outer wall of said reservoir portion, said arm motor alternatively rotating in a first direction and a second direction, said arm being lifted upwardly when said arm motor rotates in said first direction, said arm being lowered when said arm motor rotates in said second direction, said arm motor being electrically coupled to said control circuit.

7. The assembly according to claim 6, wherein each of said second scrubbing units includes a second brush being rotatably coupled between said pair of panels of said motor housing wherein said second brush is configured to frictionally engage the respective lateral wall of the bathtub.

8. The assembly according to claim 7, wherein each of said second scrubbing units includes a second brush motor being positioned in said motor housing, said second brush motor rotating in a first direction when said second brush motor is turned on, said second brush motor being electrically coupled to a control circuit.

9. The assembly according to claim 8, wherein each of said second scrubbing units includes:

a pulley being coupled to a respective end of said second brush; and a belt extending between said second brush motor and said pulley such that said second brush motor rotates said second brush when said second brush motor is turned on.

10. The assembly according to claim 1, further comprising a plurality of roller motors, each of said roller motors being positioned in said reservoir portion of said cleaner, each of said roller motors being coupled to a respective one of said rollers, each of said roller motors rotating in a first direction or a second direction when said roller motors are turned on, said cleaner moving forward when said roller motors rotate in said first direction, said cleaner moving rearwardly when said roller motors rotate in said second direction wherein said rollers are configured to move said cleaner back and forth along the basal wall of the bathtub.

11. The assembly according to claim 1, wherein said spray unit comprises a pump having an intake and a plurality of exhausts, said pump being positioned within said reservoir portion wherein said pump is configured to urge the fluid cleaning solution inwardly through said intake and outwardly through each of said exhausts when said pump is turned on, said pump being electrically coupled to said control circuit.

12. The assembly according to claim 11, wherein:

said first scrubbing unit includes a first brush;

each of said second scrubbing units includes a second brush; and said spray unit includes a plurality of conduits, each of said conduits having a primary end and a secondary end, said primary end of each of said conduits being fluidly coupled to a respective one of said exhausts of said pump wherein each of said conduits is configured to receive the fluid cleaning solution from said pump, each of said conduits being routed in said cleaner such that said secondary end of each of said conduits is aligned with a respective one of said first brush and said second brush associated with each of said second scrubbing units wherein each of said conduits is configured to spray the fluid cleaning solution into said first brush and of said second brush, said secondary end of each of said conduits defining a respective one of said outputs of said spray unit.

13. A bathtub cleaner assembly for automatically cleaning a bathtub, said assembly comprising:

a cleaner having a handle portion extending upwardly from a reservoir portion, said reservoir portion containing a fluid cleaning solution, said handle portion having a storage section being hollow wherein said storage section is configured to store objects, an outside wall of said storage section having an access opening extending into an interior of said storage section, said reservoir portion having a bottom wall, a top wall and an outer wall extending therebetween, said reservoir portion having a dividing wall being positioned between said bottom wall and said top wall to define a lower section of said reservoir portion being fluidly discrete from an upper section of said reservoir portion wherein said upper section is configured to contain the fluid cleaning solution, said outer wall having a front side, a first lateral side and a second lateral side, said front side having a pair of mounts each extending forwardly therefrom, said mounts being spaced apart from each other on said front side, each of said mounts being positioned adjacent to said bottom wall of said reservoir portion;

a control circuit being integrated into said cleaner;

a first scrubbing unit being coupled to said reservoir portion of said cleaner wherein said first scrubbing unit is configured to engage a basal wall of the bathtub when said cleaner is positioned in the bathtub, said first scrubbing unit rotating when said first scrubbing unit is turned on wherein said first scrubbing unit is configured to scrub the basal wall of the bathtub, said first scrubbing unit comprising:

a first brush having a first end and a second end, each of said first end and said second end being rotatably coupled to a respective one of said mounts on said front side of said outer wall of said reservoir portion wherein said first brush is configured to frictionally engage the basal wall of the bathtub;

a first brush motor being coupled to said reservoir portion of said cleaner, said first brush motor being in mechanical communication with said first scrubber, said first brush motor rotating in a first direction when said first brush motor is turned on, said first brush motor rotating said first scrubber when said first brush motor is turned on, said first brush motor being electrically coupled to said control circuit;

a pair of second scrubbing units, each of said second scrubbing units being movably integrated into said reservoir portion of said cleaner, each of said second scrubbing units being positioned on opposite sides of said cleaner with respect to each other, each of said second scrubbing units moving continuously between a lowered position and a raised position when said second scrubbing units are turned on wherein each of said scrubbing units is configured to scrub a respective lateral wall of the bathtub when said cleaner is positioned in the bathtub, each of said second scrubbing units comprising:

an arm having a first end and a second end, said first end being pivotally coupled to said outer wall of said reservoir portion of said cleaner;

a motor housing being coupled to said second end of said arm, said motor housing having a pair of panels being spaced apart from each other and extending away from said second end of said arm;

an arm motor being positioned within said arm, said arm motor being positioned at said first end of said arm, said arm motor engaging said outer wall of said reservoir portion, said arm motor alternatively rotating in a first direction and a second direction, said arm being lifted upwardly when said arm motor rotates in said first direction, said arm being lowered when said arm motor rotates in said second direction, said arm motor being electrically coupled to said control circuit;

a second brush being rotatably coupled between said pair of panels of said motor housing wherein said second brush is configured to frictionally engage the respective lateral wall of the bathtub;

a second brush motor being positioned in said motor housing, said second brush motor rotating in a first direction when said second brush motor is turned on, said second brush motor being electrically coupled to said control circuit;

a pulley being coupled to a respective end of said second brush; and a belt extending between said second brush motor and said pulley such that said second brush motor rotates said second brush when said second brush motor is turned on;

a plurality of rollers, each of said rollers being integrated into said reservoir portion of said cleaner wherein each of said rollers is configured to roll along the basal wall of the bathtub when said cleaner is positioned in the bathtub, each of said rollers being integrated into said bottom wall of said reservoir portion;

a plurality of roller motors, each of said roller motors being positioned in said reservoir portion of said cleaner, each of said roller motors being coupled to a respective one of said rollers, each of said roller motors rotating in a first direction or a second direction when said roller motors are turned on, said cleaner moving forward when said roller motors rotate in said first direction, said cleaner moving rearwardly when said roller motors rotate in said second direction wherein said rollers are configured to move said cleaner back and forth along the basal wall of the bathtub; and a spray unit being integrated into said cleaner, said spray unit having a plurality of outputs each being aligned with a respective one of said first scrubbing unit and said second scrubbing units, said spray unit having an input being positioned within said reservoir portion of said cleaner wherein said spray unit is configured to spray the fluid cleaning solution outwardly through each of said outputs for enhancing cleaning the bathtub, said spray unit comprising:

a pump having an intake and a plurality of exhausts, said pump being positioned within said reservoir portion wherein said pump is configured to urge the fluid cleaning solution inwardly through said intake and outwardly through each of said exhausts when said pump is turned on, said pump being electrically coupled to said control circuit; and a plurality of conduits, each of said conduits having a primary end and a secondary end, said primary end of each of said conduits being fluidly coupled to a respective one of said exhausts of said pump wherein each of said conduits is configured to receive the fluid cleaning solution from said pump, each of said conduits being routed in said cleaner such that said secondary end of each of said conduits is aligned with a respective one of said first brush and said second brush associated with each of said second scrubbing units wherein each of said conduits is configured to spray the fluid cleaning solution into said first brush and of said second brush, said secondary end of each of said conduits defining a respective one of said outputs of said spray unit;

a power switch being movably integrated into said handle portion of said cleaner, said power switch being electrically coupled to said control circuit for turning said control circuit on and off; and a power supply being positioned in said handle portion of said cleaner, said power supply being electrically coupled to said power switch, said power supply comprising at least one battery.

* * * * *